United States Patent [19]

Jeppsson

[11] 4,254,891

[45] Mar. 10, 1981

[54] STACKABLE COVER MEMBER FOR A CONTAINER

[75] Inventor: Jan-Bertil Jeppsson, Lomma, Sweden

[73] Assignee: AB Akerlund & Rausing, Sweden

[21] Appl. No.: 157,811

[22] Filed: Jun. 9, 1980

Related U.S. Application Data

[63] Continuation of Ser. No. 964,274, Nov. 28, 1978, abandoned.

[30] Foreign Application Priority Data

Dec. 1, 1977 [SE] Sweden ..... 7713670

[51] Int. Cl.[3] ..... B65D 21/02; B65D 43/03; B65D 43/06

[52] U.S. Cl. ..... 270/359; 206/503; 206/508; 220/358; 220/380

[58] Field of Search ..... 220/67, 355, 358, 359, 220/380; 206/503, 508

[56] References Cited

U.S. PATENT DOCUMENTS

| | | | |
|---|---|---|---|
| 2,623,685 | 12/1952 | Hill | 220/355 |
| 2,638,261 | 5/1953 | Poole | 220/359 |
| 3,321,104 | 5/1967 | Edwards | 206/503 |
| 3,385,470 | 5/1968 | Dorosz | 220/67 |
| 3,406,891 | 10/1968 | Buchner | 220/67 |
| 3,424,343 | 1/1969 | Hoeffelman | 220/67 |
| 3,561,982 | 2/1971 | Oeth | 220/359 |
| 3,880,288 | 4/1975 | Hunter | 220/380 |
| 4,141,463 | 2/1979 | Smith | 220/359 |

*Primary Examiner*—George E. Lowrance
*Attorney, Agent, or Firm*—Lerner, David, Littenberg & Samuel

[57] ABSTRACT

A stackable cover member for a container is provided which includes a countersunk central lid portion and a circumferential peripheral edge portion surrounding the lid portion. The edge portion of the cover member includes a flexible peripheral collar member, which is adapted to be sealed to the external sidewall of a container, and also includes an internal edge to be disposed internally within the container and which is integrally formed with the collar member. A groove is formed in the peripheral edge portion between the collar member and the internal edge for receiving an end edge of the container to which the cover member is to be sealed to. The internal edge has a transverse thickness greater than the collar member and forms the circumferential stacking edge of the cover member.

10 Claims, 6 Drawing Figures

STACKABLE COVER MEMBER FOR A CONTAINER

This is a continuation of application Ser. No. 964,274, filed on Nov. 28, 1978, now abandoned.

FIELD OF THE INVENTION

The present invention relates generally to stackable cover members for containers and specifically to such cover members which may be internally sealed to the container and which cover members may be stacked without nesting.

BACKGROUND OF THE INVENTION

Stackable cover members for containers are well known and may be employed on either the top or bottom of the container. However, such prior art cover members do not provide a simple seal arrangement which can withstand excess internal pressure which may buildup within the container. Accordingly, if an excess pressure occurs in the container, even a short exposure of the cover member to such excess pressure may result in weakening or complete loss of the internal seal, which would result in complete damage to the entire package. In addition, such prior art stackable members do not provide stacking without nesting. Accordingly, it is an object of the present invention to provide a stackable cover member for a container which overcomes one or more of the aforesaid problems. Specifically, it is within the contemplation of the present invention to provide a stackable cover member which avoids weakening of the internal seal between the cover member and container which is typically caused by excess internal pressure within the container.

It is a further object of the present invention to provide a stackable cover member for a container which includes a simple and secure internal seal arrangement and which may be stacked without nesting.

SUMMARY OF THE INVENTION

Briefly, in accordance with the principles of the present invention, an improved stackable cover member for a container is provided which includes a countersunk central lid portion and a circumferential peripheral edge portion surrounding the central lid portion. The peripheral edge portion includes a flexible peripheral collar member which is adapted to be sealed to the external sidewall of the container and also includes the internal circumferential edge portion which is adapted to be disposed within the container. The collar member is integrally formed with the internal edge and is connected thereto by a planar section which forms a continuous surface with the upper surface of the internal edge. The internal edge has a larger transverse thickness than the collar and thereby forms a circumferential stacking edge on its upper surface. A groove is formed in the peripheral edge portion between the collar member and the internal edge for receiving the end edge of the container. In addition, the underside of the cover member including the groove area is provided with a sealing layer which is adapted to be sealed to the internal wall of the container to form an internal seal and to the external wall of the container to form an external seal.

Advantageously, the stackable cover member of the present invention provides an arrangement wherein the internal stacking edge has a sufficient transverse thickness to resist any excess pressure formed within the container. Typically, in prior art arrangements, such internal excess pressures create a torque on the sealing area between the container and the cover member which operates to weaken or completely loosen the seal between the container and cover member. However, as a result of the present invention, the internal stacking edge which forms the internal seal with the internal wall of the container is of a sufficient transverse thickness to convert any such internal excess pressures within the container into a shearing force on the seal. As a result, such a shearing force has much less of an effect on loosening or weakening the internal seal than prior art arrangements, wherein the excess internal pressure is directed axially against the internal surface of the cover member to force the cover member away from the internal wall of the container and to thereby weaken or destroy the internal seal. In addition, as a result of the present invention, such an improved sealing arrangement is also accomplished in a stackable cover member which may be stacked without nesting.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
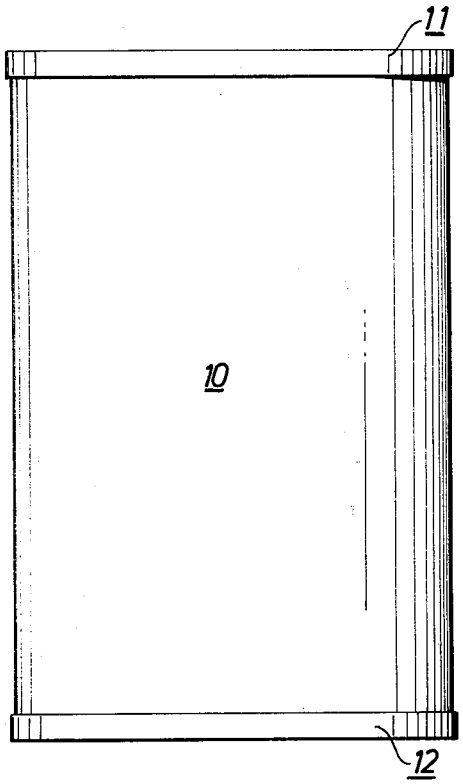
FIG. 1 is a front elevational view of a container including the stackable cover member of the present invention.
Figure 2:
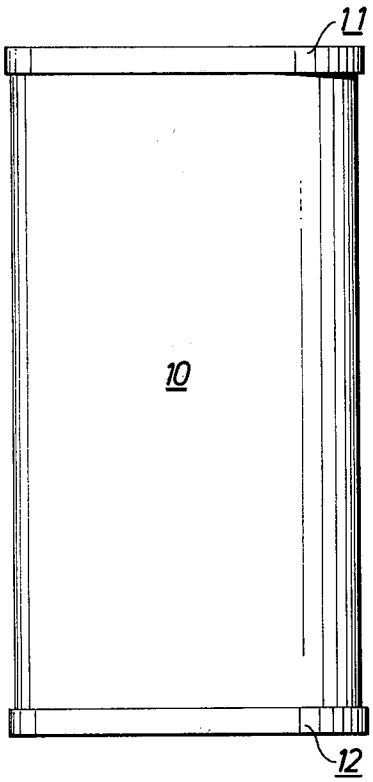
FIG. 2 is a side elevational view of the container of 30 FIG. 1.
Figure 3:
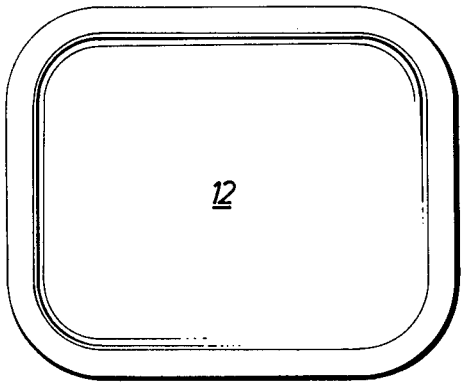
FIG. 3 is a bottom plan view of the container of FIG. 1.

As will be seen from FIGS. 1 to 3, the container is formed from a sleeve-shaped casing 10 having a substantially rectangular cross section, a top cover member 11, and a bottom cover member 12. The top and bottom cover members are identical, and the stackable cover member of the present invention is equally applicable to either cover the top or bottom of the container. Therefore, the present description applies to either a top or bottom cover member for use in conjunction with casing 10. However, in order to simplify the following description, the bottom cover member 12 will be described.

Figure 5:
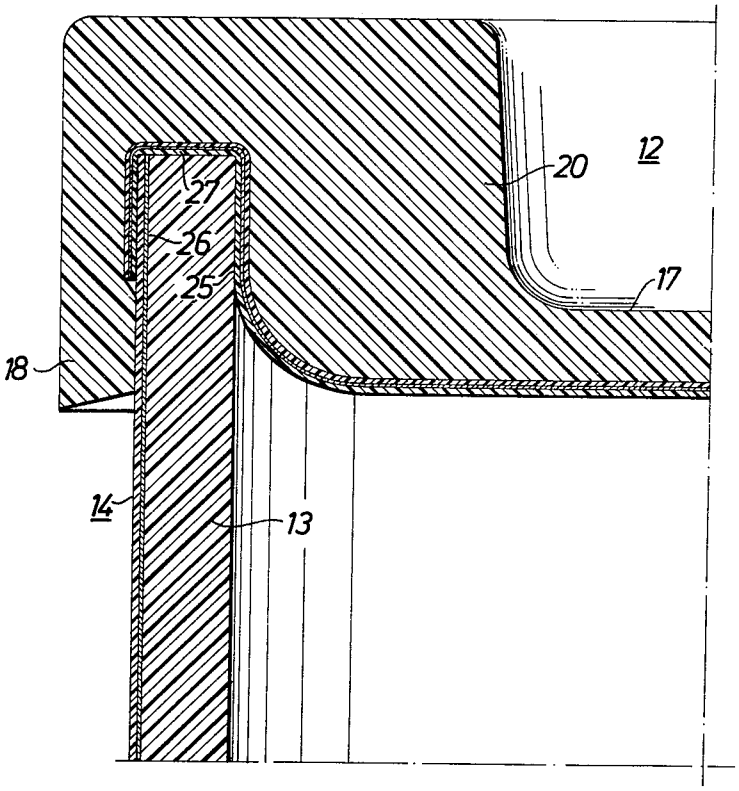
FIG. 5 is a cross-sectional view similar to FIG. 4 but with the collar member sealed to the external wall of the container.
Figure 4:
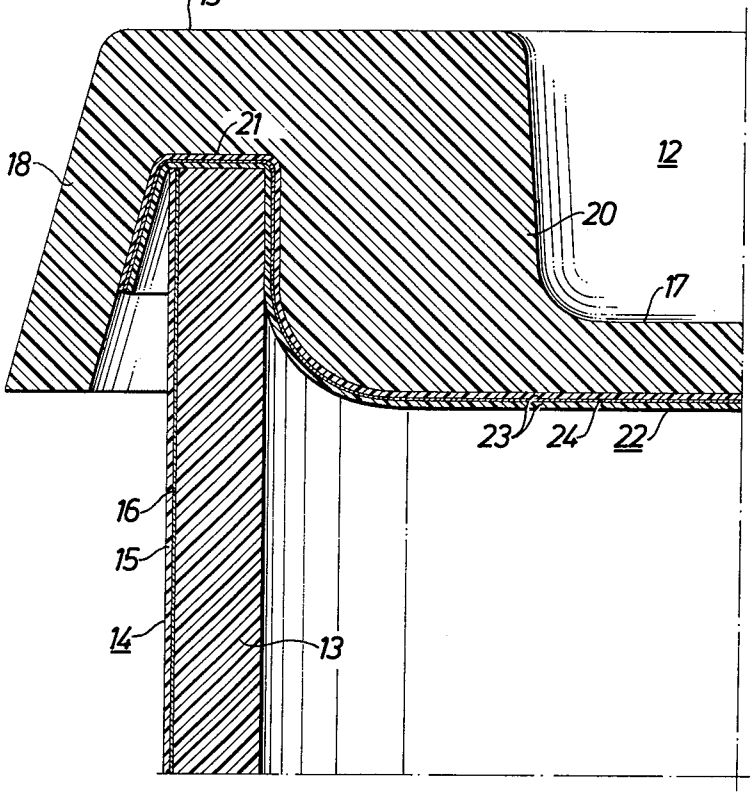
FIG. 4 is a partial cross-sectional view of a container wall and the stackable cover member of the present invention prior to the collar member of the cover member being sealed to the external wall of the container.

As shown in FIGS. 4 and 5, the casing 10 consists of an internally unbroken plastic sleeve 13 of plastic material, such as polypropylene or polyolefine, or the like, having a laminate 14 attached to the external side thereof. The laminate 14 may be formed of aluminum foil 16 coated on its exterior by a layer of polypropylene 15. In addition, the top and bottom cover members 11, 12 are formed by an injection-molding arrangement.

The stackable cover member of the present invention includes a countersunk central lid portion 17, a circumferential collar member 18, a planar transition region or section 19, an internal region 20 acting as a folding edge, and a circumferentially-extending groove 21 formed between collar member 18 and internal region 20. As will be noted, the internal region 20 has a transverse thickness of about two to five times the thickness of the collar member 18. In addition, the central lid portion 17 may have the same axial height or thickness as collar member 18.

In order to seal the cover member to the casing, the underside or internal surface of the cover member is provided with a sealing layer 22 which may consist of a layer of aluminum foil 24 coated by a layer of polypropylene 23 on both sides thereof. As will be seen, the sealing layer 22 extends into the groove area 21 and extends over internal region 20, planar section 19, and at least a portion of the internal surface of collar member 18.

Figure 6:
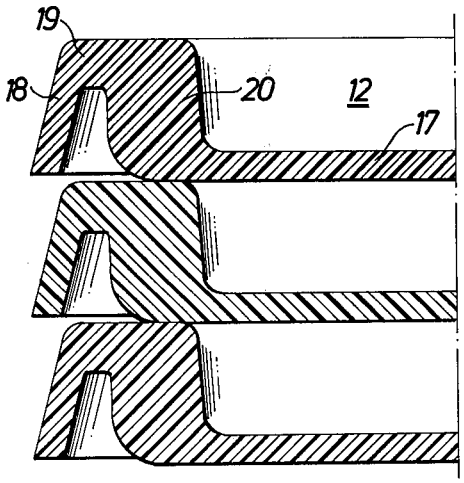
FIG. 6 is a partial cross-sectional view illustrating the stacking of the cover members of the present invention.

As will be noted, the smallest transverse width of groove 21 corresponds substantially to the transverse thickness of casing 10 in combination with the thickness of the sealing layer 22. The maximum transverse width of groove 21 is however less than the transverse width of planar section 19 and internal region 20. As a result, the transverse thickness of internal region 20 and the continuous surface formed by the upper surface of planar section 19 and internal region 20 provide for the stacking capability of the cover member of the present invention. In addition, as the central lid portion 17 is moderately countersunk, which is possible because of the internal and external seal arrangement, a pile of cover members can be stacked in storage in a relatively moderate space, as shown most clearly in FIG. 6.

The collar member 18 is of a moderate thickness and has the necessary flexibility to be moved from the position shown in FIG. 4 to that of FIG. 5 so that the collar member 18 can be welded and sealed to the external wall of the container. In addition, because of the flexibility of collar 18, the cover member is easily mounted onto the sleeve and is ready to be sealed thereto. The sealing of the cover members to the sleeve 10 may be accomplished by induction welding, as is well known in the art. This will result in an internal seal in the region 25 and an external seal in the region 26. In addition, there is also some attachment along the top edge 27 under the planar section 19.

As is well known in the art, if an excess pressure is created within the container, whether it be temporary or long term, the central lid portion exhibits a tendency to move in an axial direction or upwardly with respect to FIG. 5. This is caused by the excess pressure applying an axial force against the undersurface of the cover member. However, since the internal region 20 has a considerable thickness, as compared to the central lid portion 17, the axial force applied by the excess pressure to the undersurface of the lid portion is not transferred to the internal seal 25 as a torque, but as a result of the present invention, this force is applied to the internal seal 25 in the form of a translation displacement or shearing force. Such shearing forces have considerably less effect on internal seal 25 than the torque and forces produced in prior art arrangements.

Although the present invention has been described in connection with containers having a sealing foil, the present invention has application to containers without such foils. In addition, the present invention is also applicable to cover members which do not have an external seal.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. In a closure for a container, said closure including a central lid portion having a pair of substantially planar surfaces arranged generally opposite each other, one of said pair of surfaces facing an interior chamber of the container, and a peripheral rim portion surrounding said central lid portion, said peripheral rim portion having an inner collar extending from the other of said pair of surfaces of said central lid portion substantially normal thereto, said inner collar having a radially outermost surface sealable to an interior sidewall of the container, an outer collar attached to said inner collar and positioned substantially adjacent said radially outermost surface thereof, said outer collar having a radially innermost surface sealable to an exterior sidewall of the container and spaced a predetermined distance from said radially outermost surface of said inner collar, and receiving means formed between said radially outermost surface of said inner collar and said radially innermost surface of said outer collar for receiving an end edge of the container, the improvement wherein said inner collar has a predetermined thickness which is greater than the thickness of said outer collar and said central lid portion, said predetermined thickness of said inner collar being selected so that forces originating in the interior chamber of the container and acting on said one surface of said central lid portion in a direction substantially normal thereto are applied to an internal seal formed between said radially outermost surface of said inner collar and the interior sidewall of the container as shear forces, rather than as a torque, whereby the integrity of the internal seal may be more readily maintained without substantially increasing the amount of material required to make said closure.

2. An improved closure according to claim 1, wherein said predetermined thickness of said inner collar is selected such that said inner collar forms a stacking edge which is sufficiently wide to stack a similar closure thereon.

3. An improved closure according to claim 2, wherein said outer collar is connected to said stacking edge by a planar section which forms a continuous surface with said stacking edge.

4. An improved closure according to claim 3, wherein said receiving means is a groove having a transverse width which is less than the transverse width of said planar section and said stacking edge.

5. An improved closure according to claim 1, wherein said closure is formed of plastic material.

6. An improved closure according to claim 1, wherein said predetermined thickness of said inner collar is two to five times greater than said thickness of said central lid portion.

7. An improved closure according to claim 1, wherein said radially outermost surface of said inner collar includes sealing means for forming said seal between said radially outermost surface of said inner collar and the internal sidewall of the container.

8. An improved closure according to claim 7, wherein said radially innermost surface of said outer collar includes said sealing means, said sealing means forming an external seal between said radially innermost surface of said outer collar and the external sidewall of the container.

9. An improved closure according to claim 8, wherein said sealing means completely covers said one surface of said central lid portion of said closure.

10. An improved closure according to claim 8, wherein said transverse width of said groove is substantially equal to the thickness of the sidewall of the container plus the thickness of said sealing means.

* * * * *